US006769201B2

(12) United States Patent
Pavelescu et al.

(10) Patent No.: US 6,769,201 B2
(45) Date of Patent: Aug. 3, 2004

(54) WATERPROOF SHOE STRUCTURE

(75) Inventors: Liviu Mihai Pavelescu, Wuppertal (DE); Karsten Keidel, Wuppertal (DE)

(73) Assignee: Sympatex Technologies GmbH, Wuppertal (DE)

( * ) Notice: Subject to any disclaimer, the term of this patent is extended or adjusted under 35 U.S.C. 154(b) by 222 days.

(21) Appl. No.: 10/020,417

(22) Filed: Dec. 18, 2001

(65) Prior Publication Data

US 2002/0078593 A1 Jun. 27, 2002

(30) Foreign Application Priority Data

Dec. 18, 2000 (EP) ..... 00127682

(51) Int. Cl.[7] ..... A43B 23/07
(52) U.S. Cl. ..... 36/12; 36/14; 36/55
(58) Field of Search ..... 36/12, 14, 55, 36/21

(56) References Cited

U.S. PATENT DOCUMENTS 4,599,810 A * 7/1986 Sacre ..... 36/55
5,628,127 A 5/1997 Nötzold
5,678,326 A 10/1997 Pavelescu
6,088,935 A * 7/2000 Pavelescu et al. ..... 36/14
6,408,541 B1 * 6/2002 Moretti ..... 36/12

FOREIGN PATENT DOCUMENTS

| | | |
|---|---|---|
| EP | 0 679 347 | 11/1995 |
| EP | 0 679 347 A2 | 11/1995 |
| EP | 0 736 265 | 10/1996 |
| WO | WO 97/14326 | 4/1997 |
| WO | WO 01/21023 A1 * | 3/2001 |

* cited by examiner

*Primary Examiner*—M. D. Patterson
(74) *Attorney, Agent, or Firm*—Oliff & Berridge, PLC

(57) ABSTRACT

Waterproof shoe structure with an exterior upper (1), an interior upper containing at least a waterproof, water vapor permeable functional layer (2) and a lining (3), an insole (4), and an outsole (8). The lower end of the exterior upper (1) and the insole (4) are joined by a seam (5), wherein the functional layer (2) at the lower end of the interior upper extends past the lining (3) and possibly additional layers of the interior upper by a lower portion of the functional layer. The extending portion of the functional layer (2) is joined to the lower end of the exterior upper (1) in a waterproof manner, and that the seam (5) joining the lower end of the exterior upper (1) to the insole (4) is located exclusively in the portion (a) of the lower end of the exterior and interior uppers in which the lower portion of the functional layer is joined to the exterior upper (1) in a waterproof manner.

10 Claims, 3 Drawing Sheets

WATERPROOF SHOE STRUCTURE

BACKGROUND OF THE INVENTION

1. Field of Invention

The invention relates to a waterproof shoe structure with an exterior upper, an interior upper comprising at least a waterproof, water vapor permeable functional layer and a lining, an insole, and an outsole, wherein the lower end of the exterior upper is joined to the insole by a seam.

2. Description of Related Art

A structure of this type for shoes having an injection-molded outsole is known from EP 0 679 347 A. In the known shoe structure, the lower ends of the exterior and interior uppers are cut to different lengths, and the liquid outsole material in the injection molding process must be directed such that the lower end of the interior upper is subsequently embedded into the outsole material. Aside from the fact that this type of shoe structure offers a solution only for shoe structures with injection-molded soles, the waterproof embedding of the lower end of the interior upper causes problems in manufacturing the known shoe structure. In particular, during injection molding, when the liquid sole material presses the lower end of the interior upper against the exterior upper, it is practically unavoidable that the lining on the inside of the interior upper is brought into contact with the exterior upper, so that any moisture that might be present in the exterior upper can be transported to the shoe interior via the contact locations of the lining.

SUMMARY OF THE INVENTION

The object of the present invention is to avoid these disadvantages with a shoe structure of the type initially described.

The object is achieved with a shoe structure having an exterior upper, an interior upper comprising at least a waterproof, water vapor permeable functional layer and a lining, an insole, and an outsole, wherein the lower end of the exterior upper and the insole are joined by a seam. The functional layer at the lower portion of the interior upper extends past the lining and possibly additional layers of the interior upper by a lower portion of the functional layer so that the extending portion of the functional layer is joined to the lower end of the exterior upper in a waterproof manner, and so that the seam joining the lower end of the exterior upper to the insole is located exclusively in the portion of the lower end of the upper in which the lower portion of the functional layer is joined to the exterior upper in a waterproof manner.

BRIEF DESCRIPTION OF THE DRAWINGS

The shoe structure of the invention will be described in more detail with reference to the following figures.

DETAILED DESCRIPTION OF PREFERRED EMBODIMENTS

Figure 1:
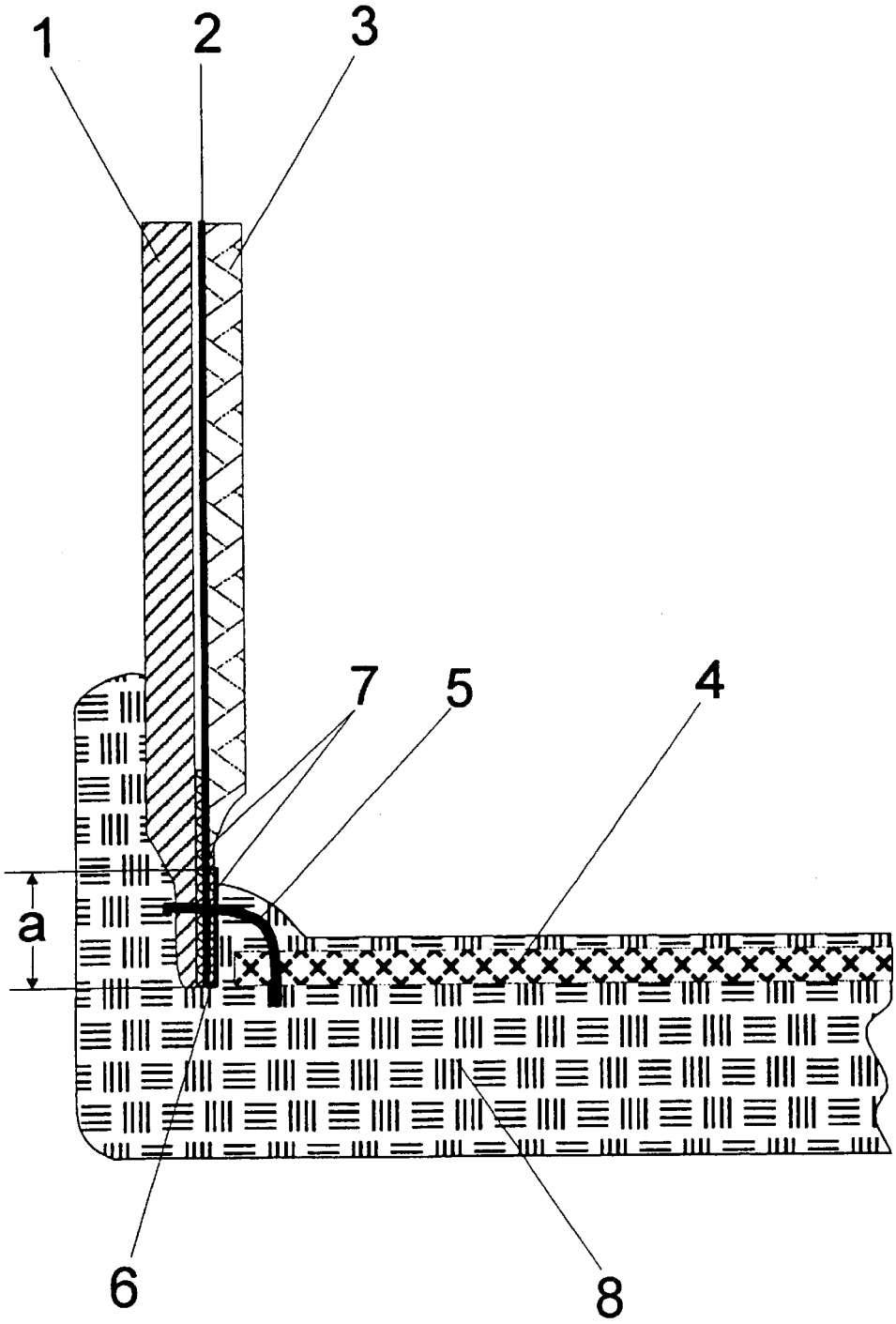
FIG. 1 shows a cross-section of an embodiment of the shoe structure of the invention with an injection-molded outsole.

The present invention is a shoe structure having an exterior upper, an interior upper comprising at least a waterproof, water vapor permeable functional layer and a lining, an insole, and an outsole, wherein the lower end of the exterior upper and the insole are joined by a seam. The functional layer at the lower end of the interior upper extends past the lining and possibly additional layers of the interior upper by a lower portion of the functional layer so that the extending portion of the functional layer is joined to the lower end of the exterior upper in a waterproof manner, and so that the seam joining the lower end of the exterior upper to the insole is located exclusively in the portion of the lower end of the upper in which the lower portion of the functional layer is joined to the exterior upper in a waterproof manner.

In this surprisingly simple fashion, moisture present in the exterior upper cannot penetrate through to the lining, because the lining terminates above the seam and thus has no opportunity to absorb the moisture contained in the exterior upper and therein transport it into the shoe interior. The waterproof joint of the extending portion of the functional layer with the lower end of the exterior upper, generally produced using an adhesive such as a polyurethane adhesive, ensures that the sensitive, normally thin functional layer is stabilized by the exterior upper. This ensures that the functional layer generally remains intact after the shoe structure has been worn extensively. At the same time, the waterproof joining of the lower portion of the functional layer to the end of the exterior upper seals the holes produced in the functional layer during the sewing process. This succeeds particularly well when a monofilament thread has been used for the seam material.

The waterproof and water vapor permeable functional layer is very thin, generally about 10 to about 100 $\mu$m, and thus very sensitive. It is not possible to make the functional layer thicker, because the water vapor permeability of the functional layer is reduced as the thickness of the functional layer increases. In the known shoe structures, a laminate is generally used for the interior upper that contains the functional layer and a textile fabric that reinforces and/or stabilizes the functional layer. This textile fabric is often the interior lining. Such an approach is intended to avoid damage to the thin and sensitive functional layer. In particular, in known shoe structures, it is ensured that, in the areas of the shoe structure subject to heavy strain, i.e., areas in which a seam is present, the reinforcing and stabilizing textile fabric is present in any case. The present invention shows that in these areas of heavy strain, there is no need for the reinforcing action of the textile fabric which is normally laminated onto the functional layer.

The manufacture of the interior upper of the shoe structure according to the invention can be effected by laminates in which the functional layer extends on one side. In the interest of economical production, the interior upper is preferably produced using a conventional laminate, and the lower portion of the functional layer is freed from the other fabrics forming the laminate during or after the manufacture of the interior upper. This can be done by scraping with a knife, for example.

The shoe structure according to the invention is characterized, in particular, in that the lower portion of the functional layer is longer than the exterior upper, and the lower portion of the functional layer is folded over such that it forms a fold edge that is at least approximately flush with the lower end of the exterior upper. In this manner, the functional layer is present twice in the critical area of the seam. It is practical in this case to glue the folded-over portion of the functional layer to the opposite portion of the functional layer, to the extent they are opposite one another.

Depending on the shoe structure design, it can be advantageous for the lower portion of the functional layer to be turned towards the outside of the shoe. It has proven especially satisfactory for the lower portion of the functional layer to be turned to the outside and folded over the lower end of the exterior upper, and for the lower portion of the functional layer to be joined in a waterproof manner to the lower end of the exterior upper from both the inside and outside of the shoe. The seam that joins the lower end of the upper to the insole is then located exclusively in the area in which the functional layer is joined in a waterproof manner to the end of the exterior upper on both the inside and outside of the shoe.

Another measure for preventing water penetration in a shoe structure of the invention with glued-on sole can be achieved in that the glued-on sole has an elevated outer portion that covers the seam joining the lower end of the exterior and interior upper to the insole. It is especially practical in this case to join the surrounding elevated portion with the end of the exterior upper in a waterproof manner, such as, for example, by gluing. In a shoe structure of the invention with glued-on sole, it can also be practical to initially glue or injection-mold an inner, preferably waterproof sole to the part of the shoe structure facing the outsole, in order to effectively seal any gap between the lower portion of the functional layer and the insole.

In a shoe structure of the invention with injection-molded sole, which can be the aforementioned injection-molded inner sole or the outsole itself, it has proven especially satisfactory for the insole to be penetrable at least at its edges by the liquid sole material during injection molding, for the seam joining the exterior upper and insole to be located in this edge area, and for the sole material to have penetrated the penetrable area at least in the vicinity of the seam. In this manner, the critical area of the shoe structure of the invention is sealed in a particularly effective manner.

It is particularly advantageous in the present shoe structure for the lower portion of the functional layer to be longer than the exterior upper and for the lower portion of the functional layer to be turned towards the inside of the shoe such that it forms a lower fold edge that is arranged at least approximately flush with the end of the exterior upper. In this manner, the functional layer in its lower portion is arranged as two adjacent layers, which are preferably joined to each other in a waterproof manner.

The injection molding of the sole in the shoe structure of the invention succeeds particularly well if the area of the insole penetrable by the liquid sole material during injection molding has a net-like structure. Production of such a shoe structure is particularly economical when the entire insole consists of a net. To attain even more protection against penetrating water, this net consists of monofilament threads.

FIG. 1 shows a shoe structure of the invention having an injection-molded outsole. At the lower end of exterior upper 1, a functional layer 2 extends past a textile-fabric lining 3 that is laminated with the functional layer 2 above the lower portion (a) of the functional layer 2 and forms an interior upper with the latter. Furthermore, the lower portion of the functional layer 2 is folded over to form a fold edge 6 that is arranged flush with the lower edge of exterior upper 1. The folded-over lower portion of the functional layer 2 is joined by layer 7 in a waterproof manner to the functional layer itself and to the lower end of the exterior upper. In area (a), in which the lower portion of the functional layer is joined to the end of the exterior upper in a waterproof manner, a seam 5 of monofilament thread joins the exterior upper and the lower portion of the functional layer to an insole 4. In this case, the insole is a net of monofilament threads. The material of outsole 8 has penetrated the net of insole 4 and on the inside forms a surface that feels comfortable to the sole of a foot. Furthermore, the outsole material envelops seam 5, so that penetration of water to the inside is practically ruled out.

Figure 2:
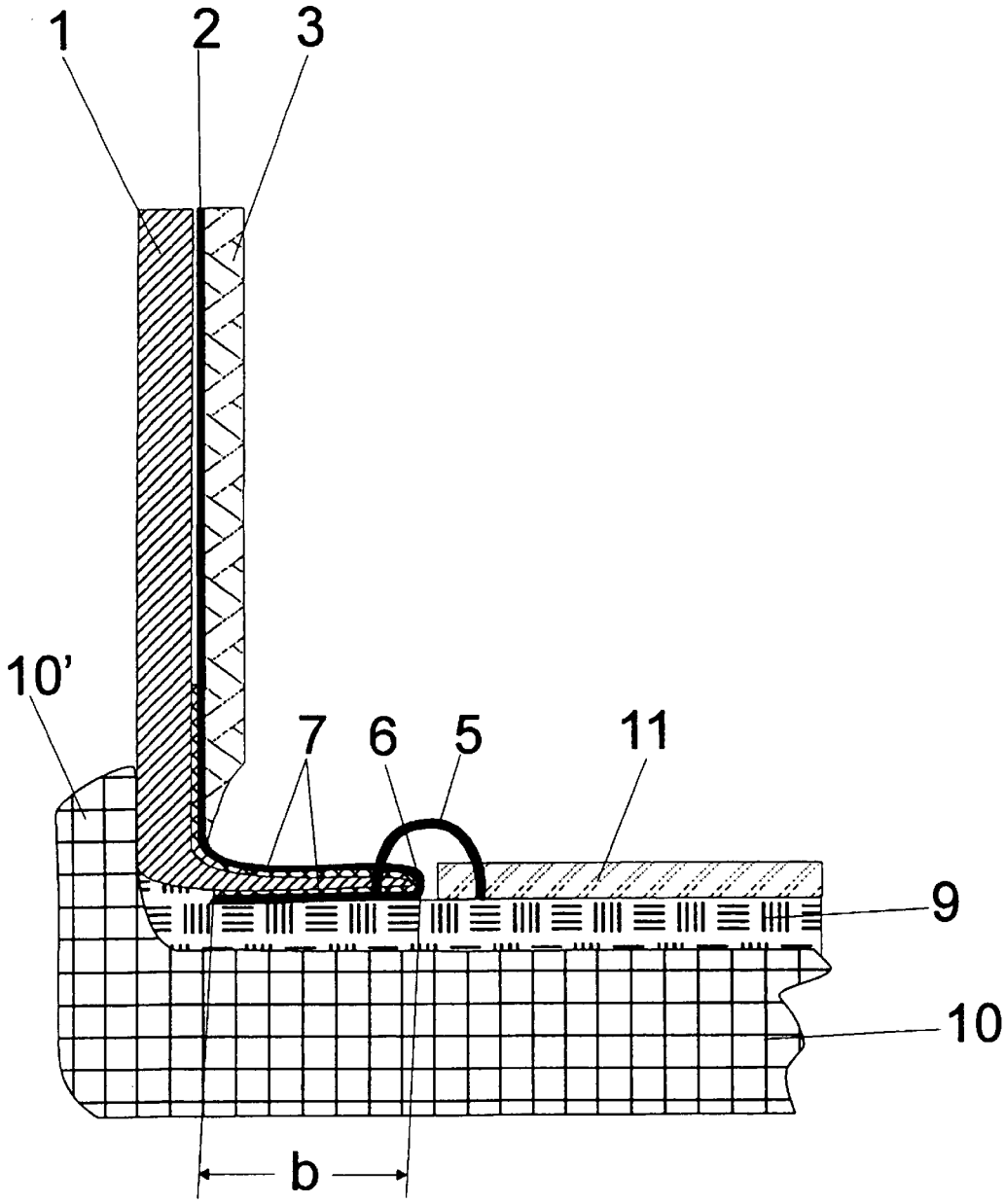
FIG. 2 shows a cross-section of another embodiment of the shoe structure of the invention with a glued-on outsole.

FIG. 2 shows a cross-section of another embodiment of the shoe structure of the invention with a glued-on outsole 10. The lower end of the exterior upper 1 in this case is folded over towards the inside of the shoe by a portion (b) and arranged approximately parallel to the outsole. The lower portion of functional layer 2 extends past lining 3 by this portion (b) and is turned towards the outside of the shoe, folded over the lower end of the exterior upper 1, and joined by a layer 7 in a waterproof manner to the exterior upper 1 on the inside and outside. The fold edge 6 of the functional layer 2 is arranged flush with the lower edge of the exterior upper 1 in area (b) in this embodiment as well. A seam 5 joins the lower end of the exterior upper 1, the functional layer 2 joined to it in a waterproof manner, and an insole 11, which has a compact structure in the illustrated case. To seal the underside of the shoe structure, an inner sole 9, comprising a waterproof material, is glued from below to portion (b) of the end of the exterior upper 1, which is turned towards the inside and covered by the lower portion of the functional layer 2, and to the insole 11. This inner sole can also be produced by applying molten plastic material, such as polyurethane, by injection molding. An outsole 10 is glued to this inner sole 11, wherein the outsole 10 has a surrounding elevated portion 10', which in the illustrated form contributes to the improved appearance of the shoe structure of the invention.

Figure 3:
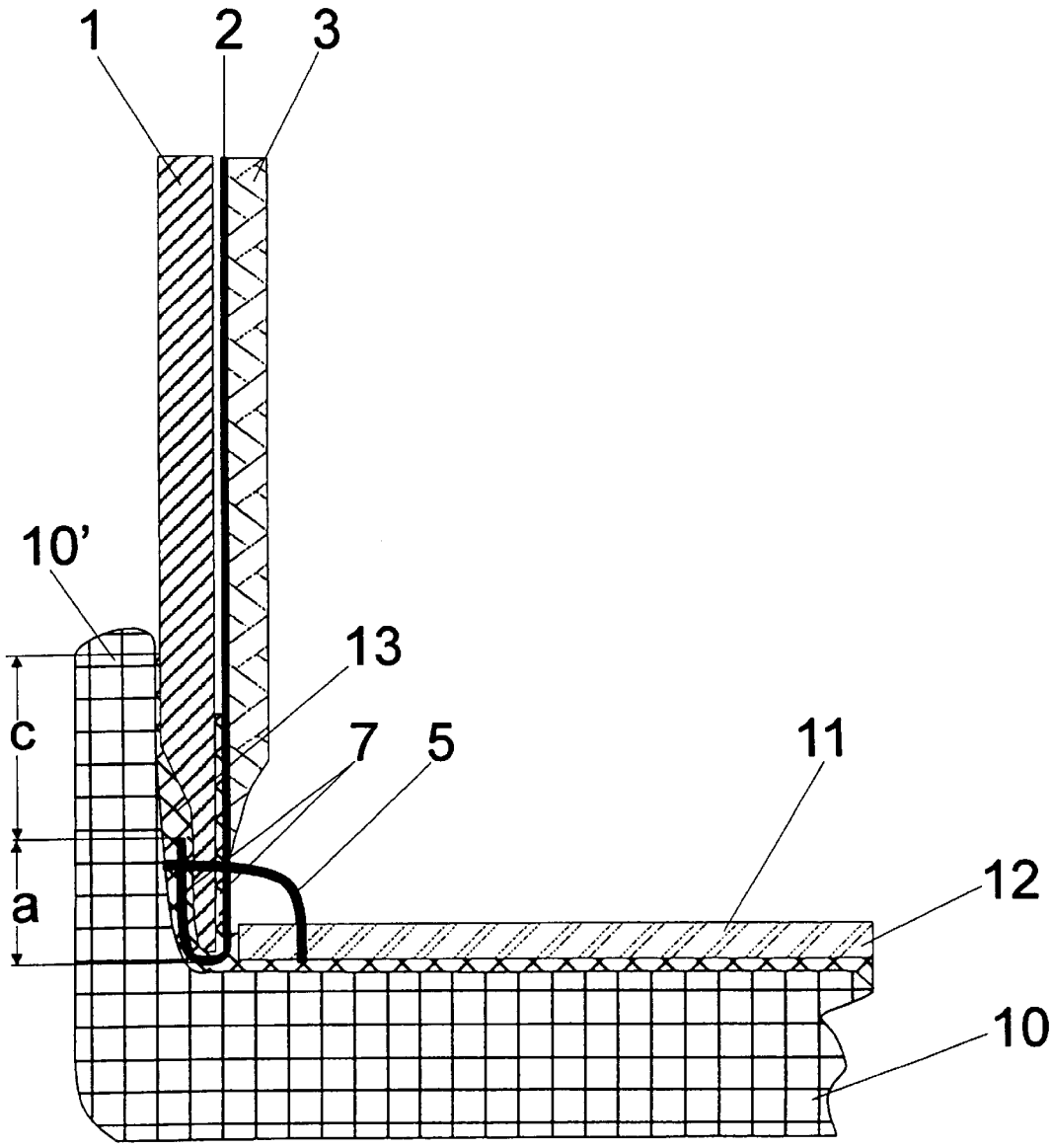
FIG. 3 shows a cross-section of another embodiment of the shoe structure of the invention with a glued-on outsole.

FIG. 3 shows a cross-section of another embodiment of a shoe structure of the invention with a glued-on outsole 10. The lower end of the exterior upper 1 is again joined in a waterproof manner to the functional layer 2 by a layer 7, which in area (a) is turned towards the outside of the shoe and folded over the end of the exterior upper 1. The seam 5, located in this area (a), again joins the exterior upper 1 and functional layer 2 to an insole 11, which also has a compact structure in this case. An outsole 10, which again has a surrounding elevated portion 10', is joined in a waterproof manner by layer 12 to the insole 11 and the lower edge of the exterior upper 1, by the outer layer 7 to area (a) of exterior upper 1 covered by the functional layer 2, and by layer 13 to the exterior upper 1 in area (c). This elevated portion 10' thus also covers, in a waterproof manner, the seam 5 in area (a) passing through the exterior upper 1, so that no water can penetrate between the elevated portion 10' and the exterior upper 1.

What is claimed is:

1. A waterproof shoe structure comprising an exterior upper, an interior upper containing at least a waterproof, water vapor permeable functional layer and a lining, an insole, and an outsole, wherein a lower end of the exterior upper and the insole being joined by a seam, wherein the functional layer at a lower end of the interior upper extends past the lining by a lower portion of the functional layer, wherein the lower portion of the functional layer extending past the lining is joined to the lower end of the exterior upper in a waterproof manner, wherein the seam joining the lower end of the exterior upper to the insole is located exclusively in the lower end of the exterior upper in which the lower portion of the functional layer is joined to the exterior upper in a waterproof manner, and wherein the lower portion of the functional layer is longer than the exterior upper, and the lower portion of the functional layer is folded over such that it forms a fold edge that is at least approximately flush with the lower end of the exterior upper.

2. The waterproof shoe structure according to claim 1, wherein the lower portion of the functional layer is turned towards the outside of the shoe.

3. The waterproof shoe structure according to claim 1, wherein the lower portion of the functional layer is turned towards an outside of the shoe and folded over the lower end of the exterior upper, and wherein the lower portion of the functional layer is joined in a waterproof manner to the lower end of the exterior upper from both an inside and the outside of the shoe such that the seam that joins the lower end of the exterior upper to the insole is located exclusively in the lower end of the exterior upper in which the lower portion of the functional layer is joined in a waterproof manner to the lower exterior upper on both the inside and the outside of the shoe.

4. The waterproof shoe structure according to claim 1, wherein the outsole is a glued-on outsole, wherein the glued-on outsole has an elevated outer portion that covers the seam joining the lower end of the exterior upper to the insole.

5. The shoe structure according claim 1, wherein the outsole is an injection-molded outsole, wherein the insole is penetrable in a penetrable area at least at an edge of the insole by a liquid sole material during injection molding, wherein the seam joining the lower end of the exterior upper and the insole is located in the penetrable area, and wherein the liquid sole material penetrates the penetrable area.

6. The waterproof shoe structure according to claim 5, wherein the lower portion of the functional layer is longer than the exterior upper and the lower portion of the functional layer is turned to an inside of the shoe such that it forms a lower fold edge that is arranged at least approximately flush with the lower end of the exterior upper.

7. The waterproof shoe structure according to claim 6, wherein the penetrable area of the insole penetrable by the liquid sole material during injection molding has a net-like structure.

8. The waterproof shoe structure according to claim 7, wherein an entirety of the insole comprises a net.

9. The waterproof shoe structure according to claim 7, wherein the net-like structure comprises monofilament threads.

10. The waterproof shoe structure according to claim 1, wherein the interior upper includes one or more additional layers in addition to the functional layer and the lining, and wherein the lower portion of the functional layer extending past the lining also extends past the additional layers.

* * * * *